US007857605B2

(12) United States Patent
Tian et al.

(10) Patent No.: US 7,857,605 B2
(45) Date of Patent: Dec. 28, 2010

(54) INLET THROTTLE CONTROLLED LIQUID PUMP WITH CAVITATION DAMAGE AVOIDANCE FEATURE

(75) Inventors: Ye Tian, Bloomington, IL (US); Alan R. Stockner, Metamora, IL (US); David C. Mack, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 951 days.

(21) Appl. No.: 11/478,318

(22) Filed: Jun. 29, 2006

(65) Prior Publication Data

US 2008/0003122 A1 Jan. 3, 2008

(51) Int. Cl.
*F04B 53/10* (2006.01)

(52) U.S. Cl. ..... 417/559

(58) Field of Classification Search ..... 417/559
See application file for complete search history.

(56) References Cited

U.S. PATENT DOCUMENTS

| | | | | | |
|---|---|---|---|---|---|
| 2,130,521 | A | * | 9/1938 | Brunner | 417/311 |
| 4,477,236 | A | * | 10/1984 | Elliott | 417/454 |
| 4,889,163 | A | | 12/1989 | Engelbertsson | |
| 5,018,703 | A | | 5/1991 | Goode | |
| 5,101,860 | A | | 4/1992 | Stephenson | |
| 5,683,228 | A | | 11/1997 | Beatty | |
| 5,701,873 | A | * | 12/1997 | Schneider | 123/516 |
| 5,931,644 | A | | 8/1999 | Glassey et al. | |
| 5,980,224 | A | | 11/1999 | Regueiro | |
| 6,544,012 | B1 | * | 4/2003 | Blume | 417/559 |
| 6,623,259 | B1 | * | 9/2003 | Blume | 417/559 |
| 6,895,992 | B2 | * | 5/2005 | Yamaguchi et al. | 137/375 |
| 7,186,097 | B1 | * | 3/2007 | Blume | 417/454 |
| 7,665,976 | B2 | * | 2/2010 | Usui et al. | 417/470 |
| 7,744,353 | B2 | * | 6/2010 | Yamada et al. | 417/273 |
| 2004/0096346 | A1 | * | 5/2004 | Usui et al. | 417/470 |
| 2004/0161353 | A1 | * | 8/2004 | Fabbri | 417/569 |

FOREIGN PATENT DOCUMENTS

| | | | |
|---|---|---|---|
| EP | 0 816 672 | A2 | 1/1998 |
| EP | 1 013 922 | A2 | 6/2000 |
| WO | WO 2005/005830 | A1 | 1/2005 |

* cited by examiner

*Primary Examiner*—Devon C Kramer
*Assistant Examiner*—Bryan Lettman
(74) *Attorney, Agent, or Firm*—Liell & McNeil

(57) ABSTRACT

A liquid pump includes an electronically controlled throttle inlet valve to control pump output. With each reciprocation cycle, a plunger displaces a fixed volume of fluid. When less than this fixed volume is desired as the output from the pump, the electronically controlled throttle inlet valve throttles flow past a passive inlet check valve to reduce output. As a consequence, cavitation bubbles are generated during the intake stroke. Cavitation damage to surfaces that define the inlet port passage are avoided by a specifically shaped and sized cavitation flow adjuster extending from the valve member of the passive inlet check valve. By positioning the cavitation flow adjuster in the inlet port passage, a flow pattern is formed in a way to encourage cavitation bubble collapse away from surfaces that could result in unacceptable cavitation damage to the pump.

19 Claims, 3 Drawing Sheets

INLET THROTTLE CONTROLLED LIQUID PUMP WITH CAVITATION DAMAGE AVOIDANCE FEATURE

TECHNICAL FIELD

The present disclosure relates generally to liquid pumps with output control via a throttle inlet valve, and more particularly to an inlet check valve that includes a cavitation flow adjuster to reduce cavitation damage in the pump.

BACKGROUND

In one class of high pressure liquid pumps, output from the pump is controlled by throttling the inlet with an electronically controlled metering valve. As a consequence, cavitation bubbles are generated when the output of the pump is controlled to be less than the volume displaced with each reciprocation of the pump plunger. One application for such a pump is in a fuel system that utilizes a common rail and a high pressure fuel pump to pressurize the rail. In this specific example, the pump is driven directly by the engine, and the output from the pump is controlled by changing the inlet flow area via the inlet throttle valve.

When the inlet throttle valve reduces the flow area to the plunger cavity, cavitation bubbles will be generated in the vicinity of the throttle valve and travel to the plunger cavity to occupy part of the volume created by the retracting plunger of the pump. When the cavitation bubbles collapse adjacent a surface, cavitation erosion can occur. In some instances, cavitation erosion can occur at undesirable locations, such as the inlet port passage. Depending upon where the cavitation damage occurs, and the amount of that damage, the pump performance can be undermined, and maybe more importantly, the eroded particles can find their way into fuel injectors possibly causing even more serious problems.

The present disclosure is directed to overcoming one or more of the problems set forth above.

SUMMARY OF THE DISCLOSURE

In one aspect, a liquid pump includes a pump barrel defining a plunger cavity, within which a plunger reciprocates. An inlet check valve is attached to the barrel and includes a seat component and a valve member. The valve member is movable between a first position in contact with the seat of the seat component and a second position out of contact with the seat. The seat is separated from the plunger cavity by an inlet port passage. The valve member includes a cavitation flow adjuster extending into the inlet port passage.

In another aspect, a method of operating a liquid pump includes generating cavitation bubbles in a liquid flowing toward a plunger cavity. A flow pattern through an inlet port passage is formed by locating a cavitation flow adjuster in the inlet port passage.

In still another aspect, a valve includes a seat component with an annular valve seat and defines a flow passage. A valve member, which includes a valve component and a cavitation flow adjuster, is guided by the seat component to move between a first position and a second position. The valve component includes a guide extension in guiding contact with the seat component, and includes an annular valve surface in contact with the valve seat at the first position to close the flow passage, and out of contact with the valve seat at the second position to open the flow passage. The cavitation flow adjuster extends away from the valve component.

DETAILED DESCRIPTION

Figure 1:
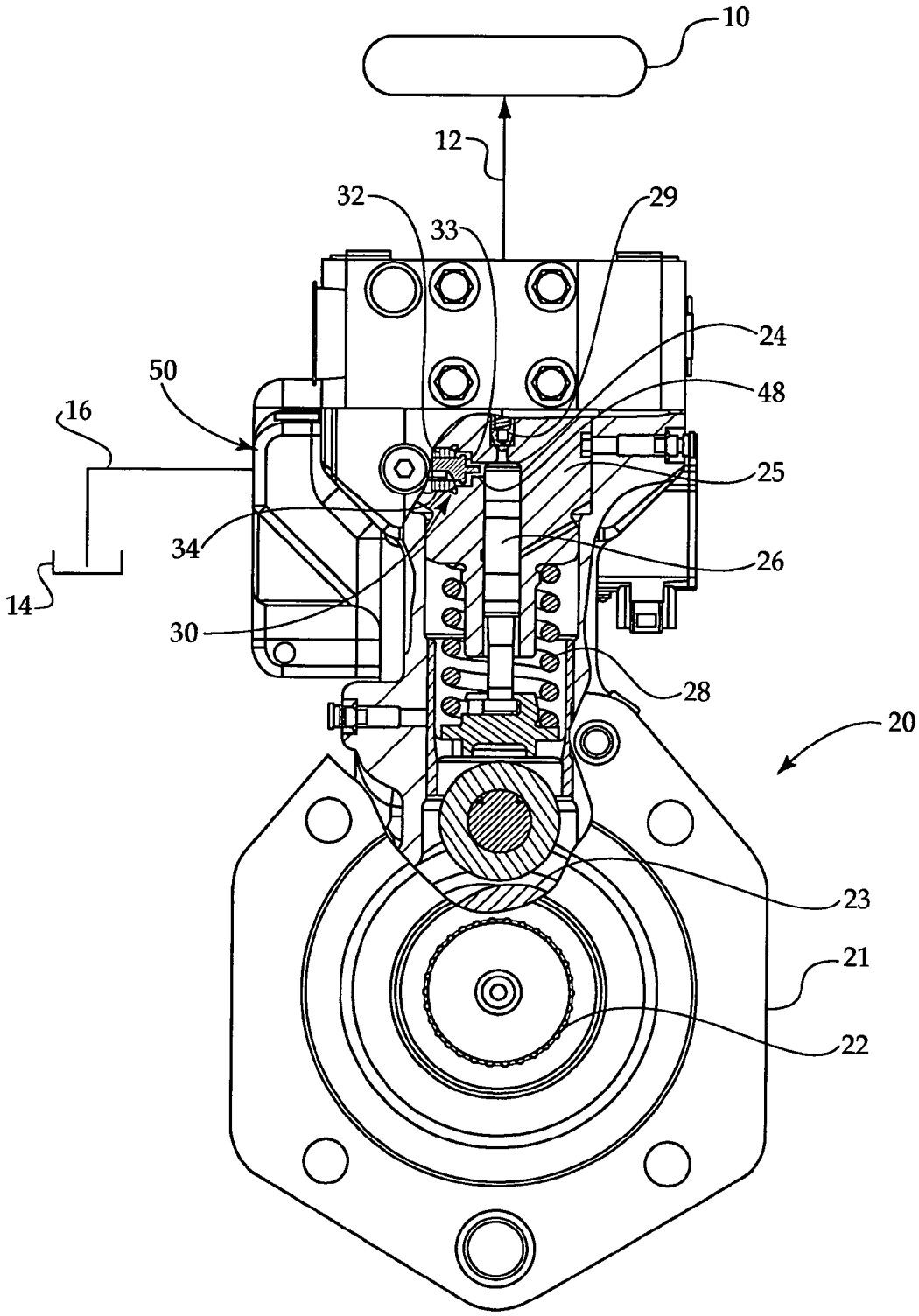
FIG. 1 is a schematic view of a liquid pump according to the present disclosure.

In some liquid systems, such as a high pressure common rail fuel system of FIG. 1, a high pressure reservoir or common rail 10 receives high pressure liquid fuel from a liquid pump 20 via an outlet flow passage 12. Pump 20 draws fuel from low pressure reservoir 14 via an inlet supply passage 16 in a conventional manner. Pump 20 includes a pump body 21 within which a drive shaft 22 rotates by being driven in a conventional manner, such as via a conventional gear train coupled to an internal combustion engine. With each rotation of drive shaft 22, a cam 23 having one or more lobes rotates. Like many similar pumps, pump body 21 includes a barrel 25 that defines a plunger cavity 24 within which a plunger 26 reciprocates in response to rotation of cam 23. A return spring 28 maintains plunger 26 at a position that follows cam 23 in a conventional manner. Thus, with each rotation of cam 23 and the corresponding reciprocation of plunger 26, the plunger reciprocates through a fixed travel distance that defines some displacement volume.

The output from pump 20 is controlled via an electronically controlled throttle inlet valve 50. Throttle valve 50 includes an electrical actuator 51, such as a proportional solenoid, piezo actuator, pilot controlled hydraulic surface, or the like, that is operably coupled to a throttle or metering valve 52, which may have any suitable construction, such as a spool valve or any other structure known to those skilled in the art. (see FIG. 2). A separate inlet check valve 30 prevents back flow of fluid from plunger cavity 24, while an outlet check valve 29 separates plunger cavity 24 from high pressure common rail 10. Those skilled in the art will recognize that when less liquid output is desired than the displacement volume defined by the reciprocation distance of plunger 26, electronically controlled throttle inlet valve 50 is actuated to reduce the inlet flow area to prevent that volume of liquid from entering plunger cavity 24. As a consequence, cavitation bubbles are generated in the liquid flowing toward plunger cavity 24 to occupy the displacement volume shortfall. Thus, an inherent property of liquid pump 20 is the creation of cavitation bubbles. While the creation of cavitation bubbles is acceptable, the present disclosure is directed toward avoiding cavitation erosion by influencing the location at which the cavitation bubbles collapse. In the context of the present disclosure, this effort is accomplished by appropriately structuring the inlet check valve 30 to encourage cavitation bubbles to collapse away from wetted surfaces.

Figures 2, 3:
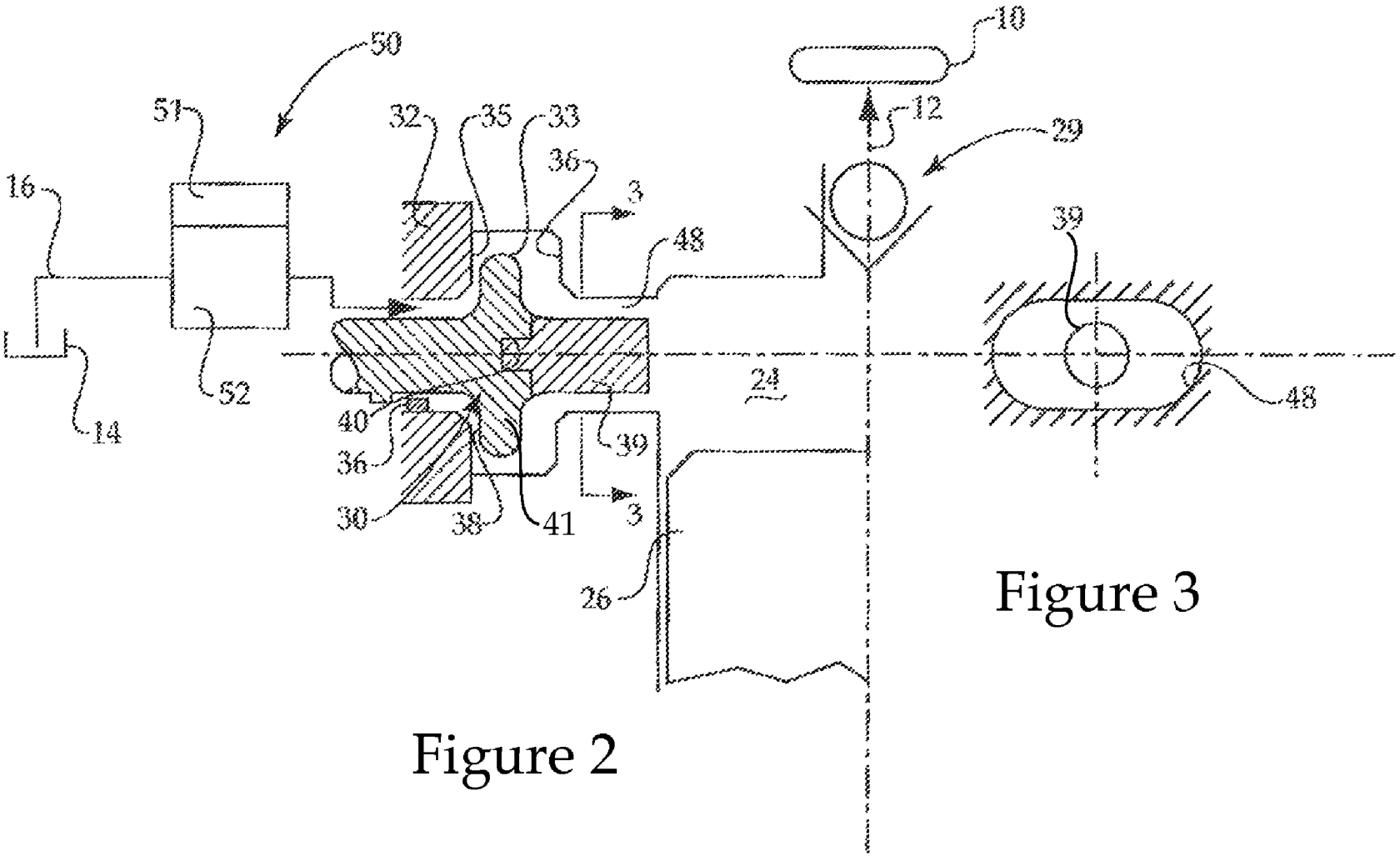
FIG. 2 is a partial schematic sectioned side view of the inlet portion of the pump of FIG. 1.
FIG. 3 is a view along the inlet port passage of FIG. 2.
Figure 4:
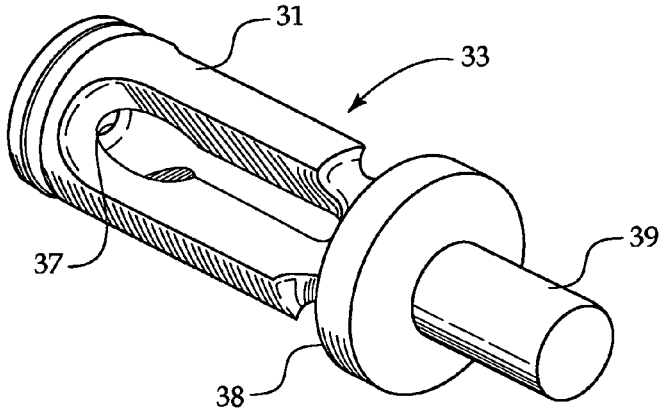
FIG. 4 is an isometric view of an inlet check valve member according to the present disclosure.

Referring now in addition to FIGS. 2, 3 and 4, inlet check valve 30 includes a seat component 32, a valve member 33 and a cavitation flow adjuster 39 extending away from valve member 33. Seat component 32 is attached to barrel 25 in any conventional manner, such as via external threads and a threaded attachment 34. When seat component 32 is attached to barrel 25 as shown, valve member 33, which includes an annular valve surface 38, is trapped to move between an annular valve seat 35 defined by seat component 32 and a stop surface 36. Stop surface 36 is defined by seat component 32 in the illustrated embodiment, but could be defined by another component, including possibly barrel 25. Valve member 33 includes a guide extension 31 that is in guiding contact with seat component 32. When valve member 33 is in a first position in contact with seat 35, inlet port passage 48, which extends between throttle inlet valve 50 and plunger cavity 24, is closed. When valve member 33 is in a second position out of contact with seat 35, inlet port passage 48 is open. In the illustrated embodiment, a spring, which is not shown and is not necessary, biases valve member 33 toward contact with seat 35. Depending upon the specific structure chosen for valve member 33, it may or may not define a flow passage segment 37 that is a portion of inlet port passage 48. In the preferred version of FIGS. 1 and 4 valve member 33 may be machined as a integral component from a single piece of metallic material without departing from the present disclosure. In the illustrations of FIGS. 2 and 3, valve member 33 includes at least two separate components, namely a valve component 41 and a cavitation flow adjuster 39. Cavitation flow adjuster 39 is attached to valve component 41 via a press fit attachment at press fit bore 40 in a conventional manner, which may include the addition of a weld.

Cavitation flow adjuster 39 may take the form of a uniform cylinder that extends all the way into plunger cavity 24 when valve member 33 is in contact with stop surface 36. Thus, in the illustrated embodiment, cavitation flow adjuster 39 includes multiple axes of symmetry that are perpendicular to a travel axis that extends along the length of valve member 33. In fact, in the illustrated embodiment, valve component 41 and cavitation flow adjuster 39 include co-linear axes of symmetry, as seen in FIG. 4. The specific size and shape of the cavitation flow adjuster 39 is based upon at least two insights according to the present disclosure. First, the cavitation flow adjuster should form flow patterns to influence the location at which cavitation bubbles will collapse. Those skilled in the art will recognize that if cavitation bubbles collapse away from wetted surfaces, such as those defining the inlet port passage, cavitation erosion can be reduced and/or avoided. A second insight, which is closely related to the first, is to size the cavitation flow adjuster to occupy space in the inlet port passage to reduce the flow area therethrough, and hence reduce static pressure in the vicinity of the cavitation flow adjuster to encourage cavitation bubbles to collapse elsewhere. However, those skilled in the art will recognize that in some versions of the present disclosure, the size and shape of the cavitation flow adjuster might be such as to encourage cavitation bubble collapse in the vicinity, or of even within, the cavitation flow adjuster 39, but away from the walls that define the inlet port passage 48. Although the illustrated cavitation flow adjuster 39 has a symmetrical circular cross section, the present disclosure contemplates cavitation flow adjusters with less symmetry, and even cavitation flow adjusters without symmetry. For instance, the cavitation flow adjuster may be shaped to encourage flow into and downward into the plunger cavity 24. Thus, those skilled in the art will appreciate that depending upon the specific internal wetted surface shapes of the pump 20, and the flow patterns resulting from the same, the cavitation flow adjuster 39 should be sized and shaped to take into account how the internal wetted surfaces influence flow in each specific application.

Figure 5:
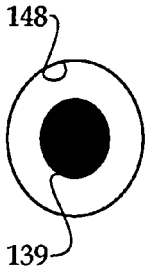
FIG. 5 is a view along the inlet port passage according to another embodiment of the present disclosure.
Figure 6:
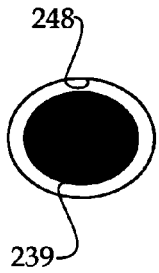
FIG. 6 is a view along the inlet port passage according to another embodiment of the present disclosure.
Figure 7:
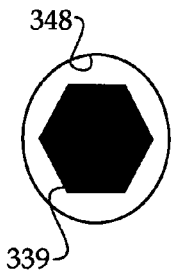
FIG. 7 is a view along the inlet port passage according to still another embodiment of the present disclosure.
Figure 8:
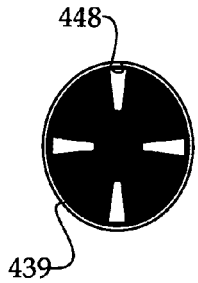
FIG. 8 is a view along the inlet port passage according to another embodiment of the present disclosure.
Figure 9:
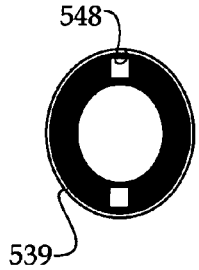
FIG. 9 is a view along the inlet port passage according to still another embodiment of the present disclosure.

Referring to FIGS. 5-9, other example cavitation flow adjuster sizes and shapes are illustrated. For instance, FIG. 5 shows a circular inlet port passage 148 that includes a cavitation flow adjuster 139 similar to that of cavitation flow adjuster 39. The difference in this example is that the inlet port passage 48 has a circular cross section, whereas in the illustrated embodiment, as best seen in FIG. 3, the inlet port passage has an oval shape in the vicinity of stop surface 36. FIG. 6 shows another example in which the cavitation flow adjuster 39 includes an oval shape in conjunction with an inlet port passage 48 that also includes an oval shape. Those skilled in the art will recognize that the cavitation flow adjuster 239 can occupy a substantial amount of space in the inlet port passage 248 so that static pressure in flow through the inlet port passage 48 is maintained low in the vicinity of the cavitation flow adjuster, thus encouraging cavitation bubbles to collapse elsewhere, such as in the plunger cavity. It should be noted that the cavitation flow adjuster should not introduce a flow restriction in inlet port passage 48 relative to any flow area that might be chosen for throttle inlet valve 50. FIG. 7 shows still another example in which a circular cross section inlet port passage 348 is shown in conjunction with a hexagonally shaped cavitation flow adjuster 339. FIG. 8 shows still another embodiment in which a circular cross section inlet port passage 448 is occupied in part by a cavitation flow adjuster 439 that includes slots that encourage the flow into a cavitation flow adjuster 439 and away from the walls defining inlet port passage 448. FIG. 9 shows still another embodiment in which a circular cross section inlet port passage 548 is occupied by a partially hollow cavitation flow adjuster 539 that includes side ports and a central opening to encourage flow into and out of an end of the cavitation flow adjuster. Thus, those skilled in the art will appreciate that by employing the insights of the present disclosure, a size and appropriately shaped cavitation flow adjuster can be devised for virtually any electronically controlled throttle inlet valve liquid pump to encourage avoidance of cavitation erosion damage, particularly in the inlet port passage and adjacent other surfaces where cavitation damage is undesirable.

INDUSTRIAL APPLICABILITY

The present disclosure finds potential application to any throttle inlet controlled liquid pump that inherently produces cavitation bubbles in liquid flowing to the plunger cavity during normal operations. The present disclosure is directed toward adjusting flow in the inlet port passage to encourage cavitation bubbles to collapse away from surfaces where cavitation erosion is undesirable. The present disclosure finds specific application in some high pressure pumps for high pressure common rail fuel systems often employed in compression ignition engines. Throttle inlet controlled pumps are specifically desirable in these applications because of there simplicity of operation and construction. However, excessive cavitation erosion damage can reduce the attractiveness of these pumps. The present disclosure addresses these issues by appropriately forming a flow pattern in the inlet port passage to influence the cavitation bubble collapse location pattern in a way that results in acceptable cavitation erosion within the pump to provide the same with a long useful working life. As stated earlier, this goal can be accomplished by utilizing a cavitation flow adjuster formed as part of, or attached to, the inlet check valve member to reduce a flow area in the inlet port passage to encourage cavitation bubble collapse elsewhere, and shaping the cavitation flow adjuster to further influence flow patterns downstream or in the vicinity of the cavitation flow adjuster to encourage the cavitation bubbles to collapse at locations harmless to the working life of the pump in question.

It should be understood that the above description is intended for illustrative purposes only, and is not intended to limit the scope of the present invention in any way. For instance, it might be desirable to size and shape the cavitation flow adjuster to encourage cavitation bubble collapse erosion on the cavitation flow adjuster. In some such cases, the valve member that includes the cavitation flow adjuster might be a serviceable component of the pump. Thus, those skilled in the art will appreciate that other aspects of the invention can be obtained from a study of the drawings, the disclosure and the appended claims.

What is claimed is:

1. A liquid pump comprising:

a pump barrel defining a plunger cavity;

a plunger positioned to reciprocate in the plunger cavity;

an inlet check valve attached to the barrel, and including a seat component and a valve member;

the valve member being movable between a first position in contact with a seat of the seat component, and a second position out of contact with the seat;

the seat being separated from the plunger cavity by an inlet port passage;

the valve member including a cavitation flow adjuster extending into the inlet port passage to occupy space in the inlet port passage to reduce a flow area therethrough, reducing a static pressure in a vicinity of the cavitation flow adjuster to encourage cavitation bubbles to collapse away from walls that define the inlet port passage; and a throttle inlet valve that generates cavitation bubbles when actuated to reduce an inlet flow area.

2. The pump of claim 1 including a stop surface; and the valve member is in contact with the stop surface when in the second position, but out of contact with the stop surface when in the first position.

3. The pump of claim 2 wherein the cavitation flow adjuster extends into the plunger cavity.

4. The pump of claim 3 wherein the inlet port passage has an eccentric cross section adjacent the plunger cavity.

5. The pump of claim 4 wherein the valve member includes an integrally machined pin extending away from a valve component.

6. The pump of claim 5 wherein the valve component defines a flow passage segment therethrough.

7. The pump of claim 6 wherein the pin has at least one plane of symmetry.

8. The pump of claim 7 wherein the pin has at least two planes of symmetry.

9. The pump of claim 1 wherein the valve member includes a guide extension in guide contact with the seat component throughout movement between the first position and the second position.

10. The pump of claim 1 wherein the throttle inlet valve includes an electrical actuator operable to reduce a flow area to the plunger cavity when actuated.

11. The pump of claim 10 including a stop surface; and the valve member is in contact with the stop surface when in the second position, but out of contact with the stop surface when in the first position.

12. The pump of claim 11 wherein the cavitation flow adjuster extends into the plunger cavity.

13. The pump of claim 12 wherein the inlet port passage has an eccentric cross section adjacent the plunger cavity.

14. The pump of claim 13 wherein the valve member includes an integrally machined pin extending away from a valve component.

15. The pump of claim 14 wherein the valve component defines a flow passage segment therethrough.

16. The pump of claim 15 wherein the pin has at least one plane of symmetry.

17. The pump of claim 16 wherein the pin has at least two planes of symmetry.

18. The pump of claim 17 wherein the valve member includes a guide extension in guide contact with the seat component throughout movement between the first position and the second position.

19. The pump of claim 10 wherein the valve member includes a guide extension in guide contact with the seat component throughout movement between the first position and the second position.

* * * * *